US007094162B2

(12) United States Patent
Sajima

(10) Patent No.: US 7,094,162 B2
(45) Date of Patent: Aug. 22, 2006

(54) GOLF BALL

(75) Inventor: Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/943,130

(22) Filed: Sep. 17, 2004

(65) Prior Publication Data

US 2005/0113188 A1 May 26, 2005

(30) Foreign Application Priority Data

Nov. 26, 2003 (JP) ..... 2003-395048

(51) Int. Cl.
*A63B 37/14* (2006.01)

(52) U.S. Cl. ..... 473/384

(58) Field of Classification Search ..... 473/383–384
See application file for complete search history.

(56) References Cited

U.S. PATENT DOCUMENTS 4,979,747 A 12/1990 Jonkouski
5,016,887 A * 5/1991 Jonkouski ..... 473/379
5,338,039 A 8/1994 Oka et al.

* cited by examiner

*Primary Examiner*—Raeann Gorden
(74) *Attorney, Agent, or Firm*—Birch,Stewart,Kolasch, and Birch,LLP

(57) ABSTRACT

Golf ball 28 has a first side face 32, a second side face 34 and a third side face 36. The first side face 32 is positioned between an edge E and a point P. The second side face 34 is positioned between the point P and a point Q. The third side face 36 is positioned between the point Q and a point R. Each side face 32, 24, 36 is inclined in the in-depth direction toward the inward side. An angle $\alpha 1$ of the first side face 32 is 2.0° or greater and 11.0° or less. An angle $\alpha 2$ of the second side face 34 and an angle $\alpha 3$ of the third side face 36 are equal to or less than 30.0°. The angle $\alpha 3$ is greater than the angle $\alpha 2$. The angle $\alpha 2$ is greater than the angle $\alpha 1$. The golf ball 28 also has a curved face 38. The curved face 38 is a part of a spherical surface.

9 Claims, 8 Drawing Sheets

GOLF BALL

This application claims priority on Patent Application No. 2003-395048 filed in Japan on Nov. 26, 2003.

BACKGROUND OF THE INVENTION

1. Field of the Invention

The present invention relates to golf balls. More particularly, the present invention relates to an improvement of the shape of dimples.

2. Description of the Related Art

Golf balls have numerous dimples on the surface thereof. A role of the dimples involves causing turbulent flow separation through disrupting the air flow around the golf ball during the flight. This role is referred to as a "dimple effect". By causing the turbulent flow separation, a separating point of air from the golf ball shifts backwards leading to the reduction of a drag. The turbulent flow separation promotes the differentia between the separating points at the upper and lower sides of the golf ball, which result from the backspin, thereby enhancing the lift force that acts upon the golf ball. Excellent dimples disturb the air flow more efficiently.

Cross-sectional shape of the dimple affects flight performances of a golf ball. A variety of improvements of the cross-sectional shape of the dimples in an attempt to improve the flight performance have been proposed. U.S. Pat. No. 4,979,747 discloses a golf ball provided with dimples having a cross-sectional shape being a truncated cone. U.S. Pat. No. 5,338,039 discloses dimples having a great angle of inclination in the vicinity of the dimple edge while having a low angle of inclination in the vicinity of the center thereof.

Top concern to golf players for golf balls is the travel distance. In light of the flight performance, there remains room for an improvement of the cross-sectional shape of the dimple. An object of the present invention is to provide a golf ball that is excellent in the flight performance.

SUMMARY OF THE INVENTION

The golf ball according to the present invention has numerous dimples on the surface thereof. This dimple includes a truncated cone part having a side face inclined in the in-depth direction from the edge toward the inward side. An angle $\alpha 1$ of this side face with respect to the radial direction is 2.0° or greater and 11.0° or less. Preferably, the dimple has a bowl-shaped part which is positioned at the center thereof.

Other golf ball according to the present invention has numerous dimples on the surface thereof. This dimple includes:

(1) a first truncated cone part having a side face inclined in the in-depth direction from the edge toward the inward side;

(2) a second truncated cone part having a side face inclined in the in-depth direction toward the inward side, and continuing to the first truncated cone part; and (3) a bowl-shaped part which is positioned at the center thereof. An angle $\alpha 1$ of this side face of the first truncated cone part with respect to the radial direction is 2.0° or greater and 11.0° or less. Preferably, an angle $\alpha 2$ of the side face of the second truncated cone part with respect to the radial direction is greater than the angle $\alpha 1$. The angle $\alpha 2$ equal to or less than 30.0°.

Still other golf ball according to the present invention has numerous dimples on the surface thereof. This dimple includes:

(1) a first truncated cone part having a side face inclined in the in-depth direction from the edge toward the inward side;

(2) a second truncated cone part having a side face inclined in the in-depth direction toward the inward side, and continuing to the first truncated cone part;

(3) a third truncated cone part having a side face inclined in the in-depth direction toward the inward side, and continuing to the second truncated cone part; and (4) a bowl-shaped part which is positioned at the center thereof. An angle $\alpha 1$ of this side face of the first truncated cone part with respect to the radial direction is 2.0° or greater and 11.0° or less. Preferably, an angle $\alpha 2$ of the side face of the second truncated cone part with respect to the radial direction is greater than the angle $\alpha 1$. The angle $\alpha 2$ is equal to or less than 30.0°. An angle $\alpha 3$ of the side face of the third truncated cone part with respect to the radial direction is greater than the angle $\alpha 2$. The angle $\alpha 3$ is equal to or less than 30.0°.

DESCRIPTION OF THE PREFERRED EMBODIMENTS

The present invention is hereinafter described in detail with appropriate references to the accompanying drawing according to the preferred embodiments of the present invention.

Figure 1:
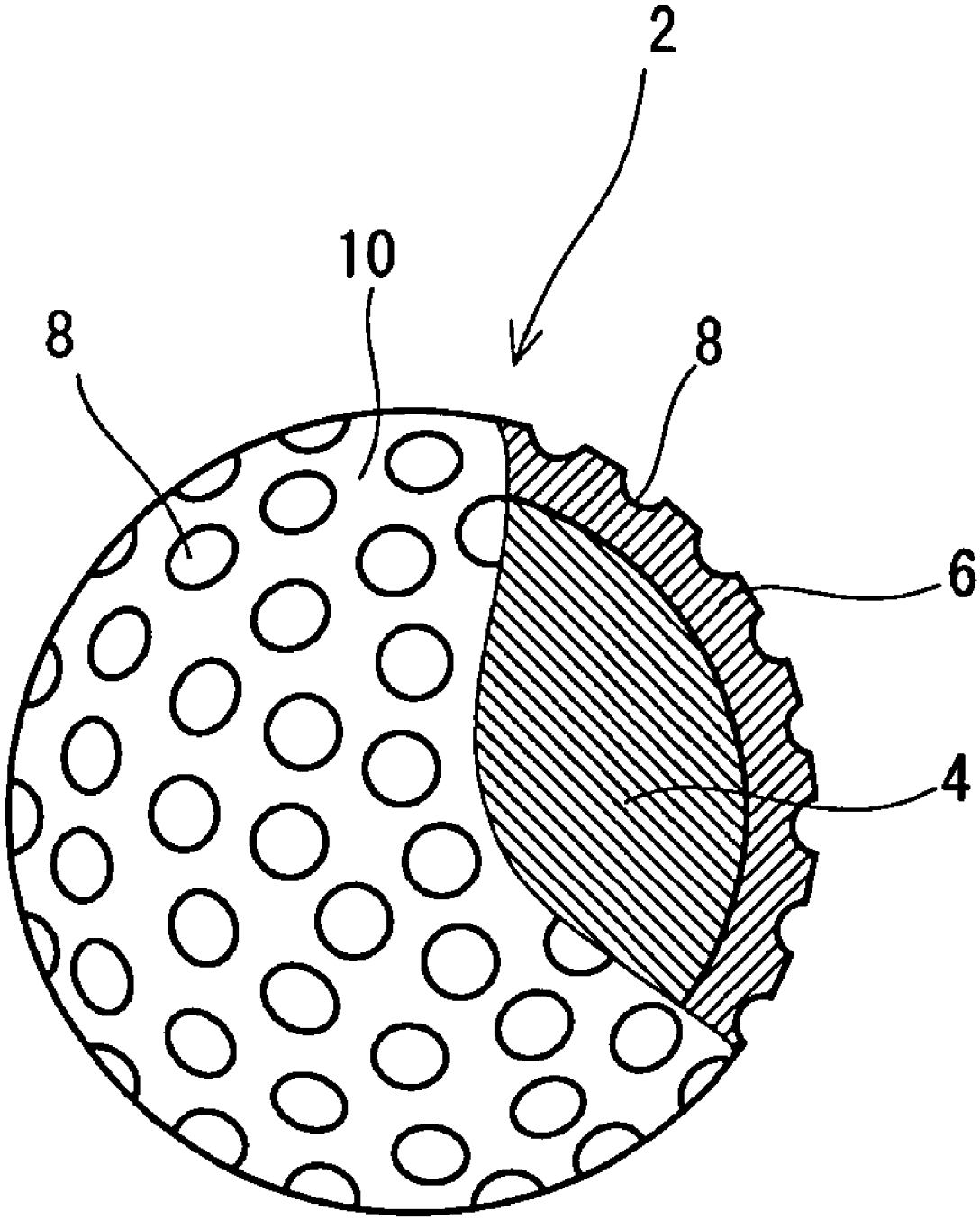
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. Of the surface of the golf ball 2, parts other than the dimples 8 are lands 10. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

Figure 2:
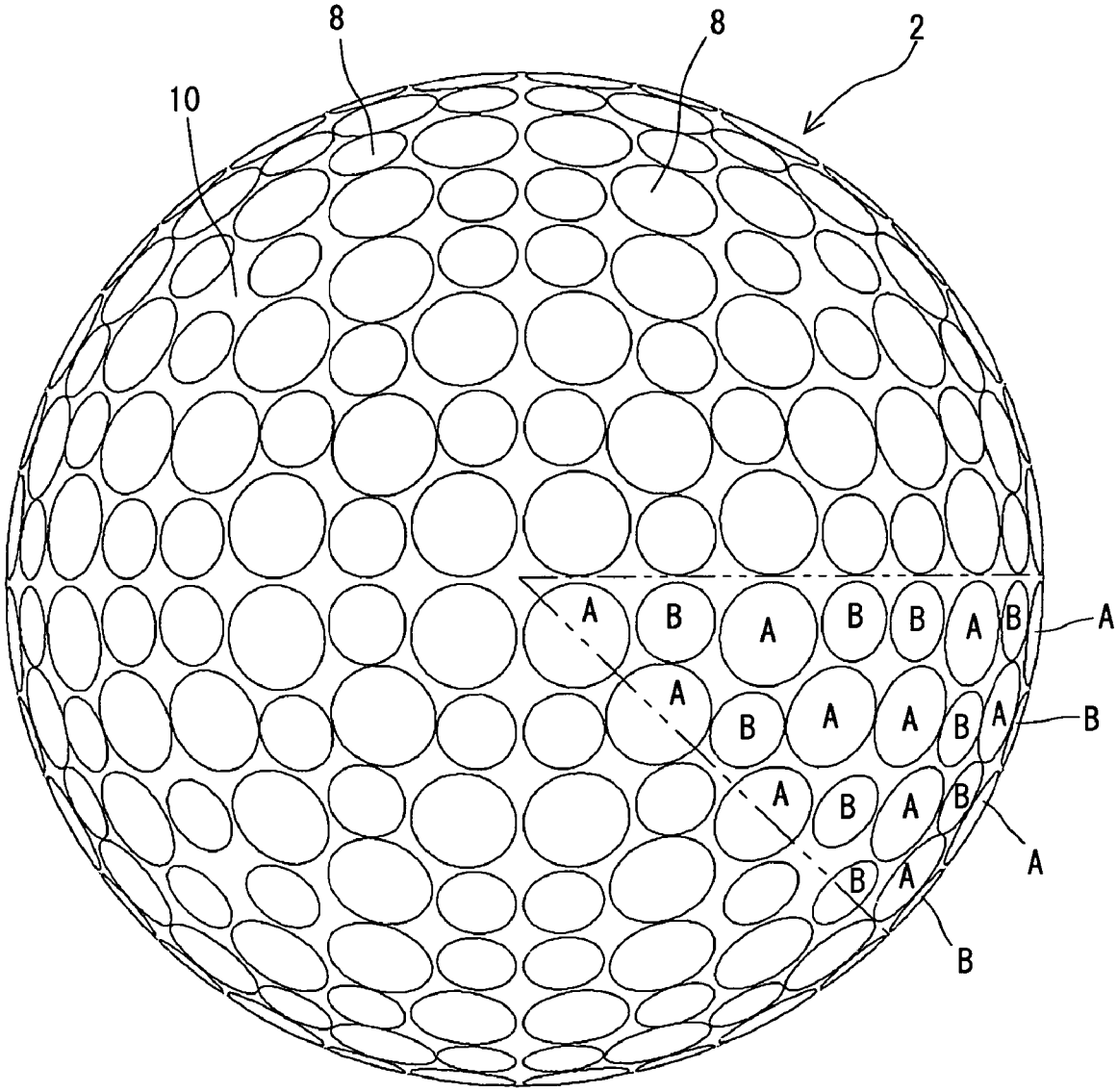
FIG. 2 is an enlarged front view illustrating the golf ball shown in FIG. 1.

FIG. 2 is an enlarged front view illustrating the golf ball 2 shown in FIG. 1. As is clear from FIG. 2, the plane shape of all the dimples 8 is circular. In FIG. 2, kinds of the dimples 8 are illustrated by symbols A and B in one unit, provided when the surface of the golf ball 2 is comparted into sixteen equivalent units. This golf ball 2 has dimples A having a diameter of 4.65 mm and dimples B having a diameter of 3.50 mm. The number of the dimples A is 168; and the number of the dimples B is 168. Total number of the dimples 8 of this golf ball 2 is 336. In FIG. 2, an edge inside of the dimple is not depicted.

Figure 3:
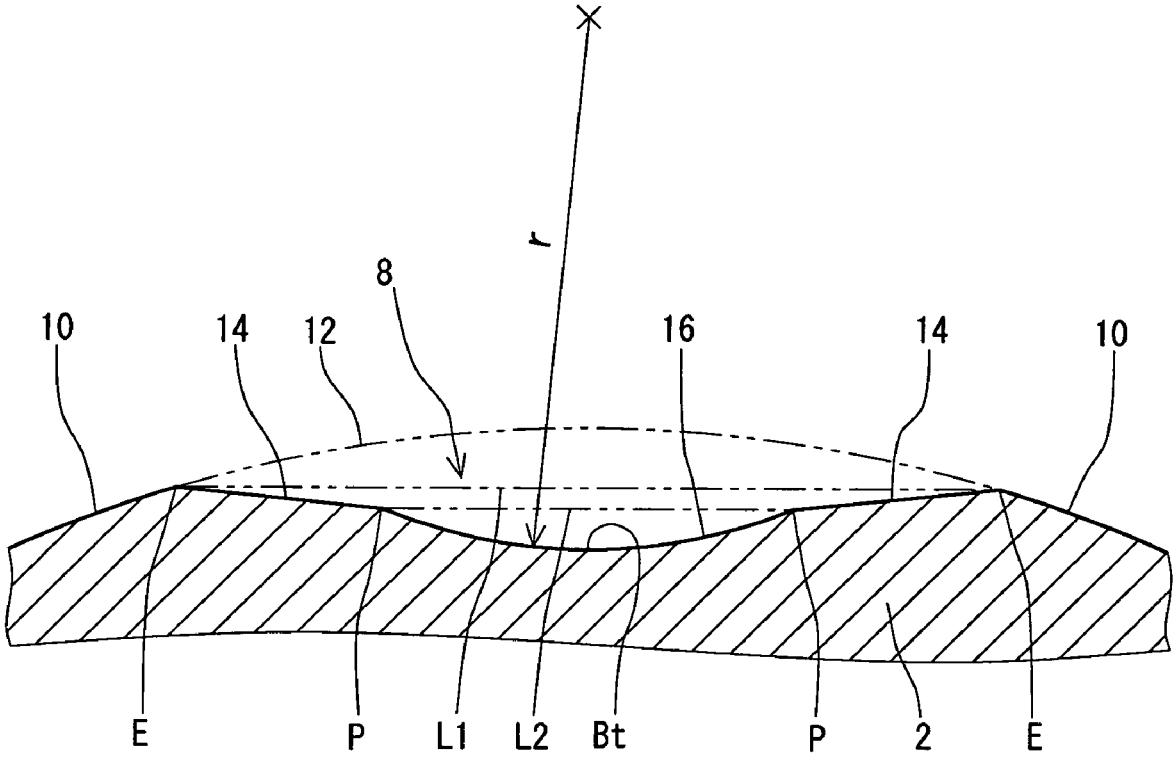
FIG. 3 is an enlarged cross-sectional view illustrating a part of the golf ball shown in FIG. 1.

FIG. 3 is an enlarged cross-sectional view illustrating a part of the golf ball 2 shown in FIG. 1. In this Figure, a face traversing the deepest point Bt of the dimple 8 and the center of the golf ball 2 is shown. A top-to-bottom direction in FIG. 3 is an in-depth direction of the dimple 8. The in-depth direction is a direction from the weighted center of area of the dimple 8 toward the center of the golf ball 2. A horizontal direction in FIG. 3 is a radial direction of the dimple 8. What is indicated by a chain double-dashed line 12 in FIG. 3 is a phantom sphere. The surface of the phantom sphere 12 corresponds to a surface of the golf ball 2 when it is postulated that there is no dimple 8 existed. The dimple 8 is recessed from the phantom sphere 12. The land 10 agrees with the phantom sphere 12.

A side face 14 is depicted in FIG. 3. The side face 14 has a ring shape. In FIG. 3, the side face 14 is depicted as a line segment. The side face 14 is positioned between a point E and a point P. The point E corresponds to the edge of the dimple 8. The edge E is a boundary between the dimple 8 and the land 10. The edge E defines the plane shape of the dimple 8. The side face 14 is inclined in the in-depth direction from the edge E toward the inward side.

A curved face 16 is also depicted in FIG. 3. The curved face 16 is positioned below the point P. The point P is a boundary between the side face 14 and the curved face 16. The curved face 16 is positioned at the center of the dimple 8. The curved face 16 is a part of a spherical surface. In FIG. 3, the curved face 16 is depicted as a circular arc having a curvature radius of r. The curved face 16 is protruded downward. The curved face 16 may have a plurality of curvature radii.

What is indicated by a symbol L1 in FIG. 3 is a line segment connecting the edges E on both sides. What is indicated by a symbol L2 is a line segment connecting the points P on both sides. A truncated cone part is formed with a horizontal plane including the line segment L1, a horizontal plane including the line segment L2 and the side face 14. The length of the line segment L1 is a diameter of the bottom face of the truncated cone part. The length of the line segment L1 is also a diameter of the dimple 8. The bowl-shaped part is formed with the horizontal plane including the line segment L2 and the curved face 16. The length of the line segment L2 is a diameter of the bowl-shaped part. The horizontal plane herein corresponds to a plane that is orthogonal to the in-depth direction.

A distance between the line segment L1 and the line segment L2 is the height of the truncated cone part. A distance between the line segment L2 and the deepest point Bt is the height of the bowl-shaped part. Sum total of the height of the truncated cone part and the height of the bowl-shaped part is the depth of the dimple 8. Sum total of the volume of the truncated cone part and the volume of the bowl-shaped part is the volume of the dimple 8.

Figure 4:
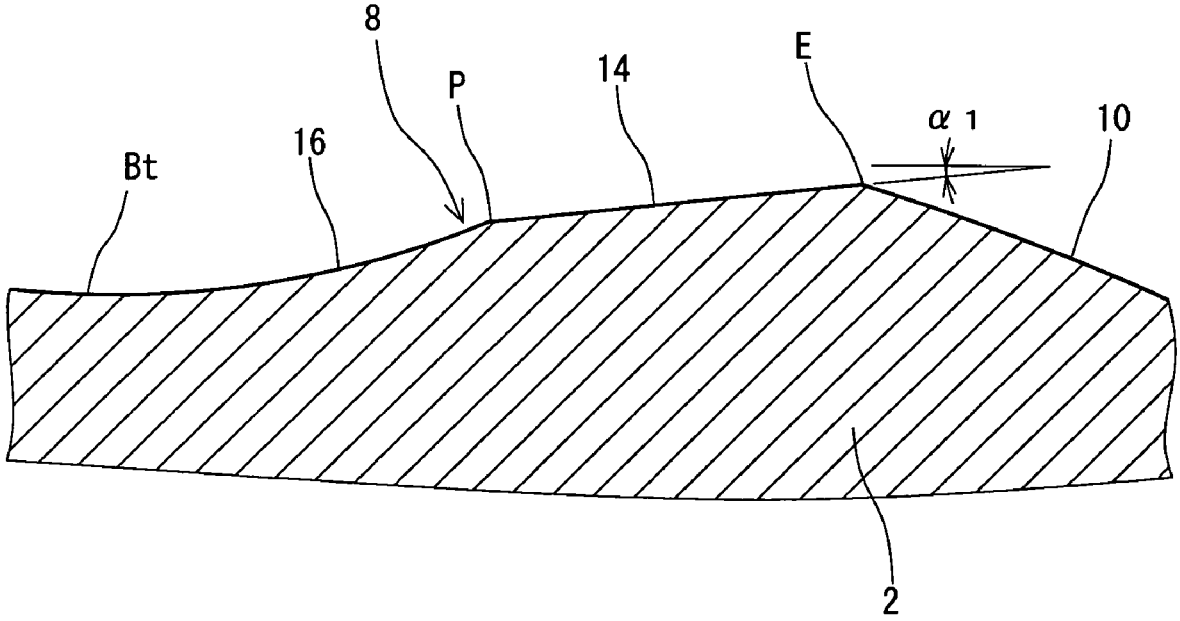
FIG. 4 is a cross-sectional view illustrating the further enlarged golf ball shown in FIG. 3.

FIG. 4 is a cross-sectional view illustrating the further enlarged golf ball 2 shown in FIG. 3. What is indicated by an arrowhead $\alpha$1 in FIG. 4 is an angle of the side face 14 with respect to the radial direction. The angle $\alpha$1 is equal to or less than 11.0°. The angle $\alpha$1 is extremely small. According to this dimple 8, the air flowing from the land 10 toward the deepest point Bt along the side face 14 hardly causes separation. The air smoothly flows into the bowl-shaped part. The cross-sectional shape of the curved face 16 is a circular arc as described above, the air flowed into the bowl-shaped part smoothly flows out along the curved face 16. Accordingly, a great dimple effect is achieved. In other words, the truncated cone part and the bowl-shaped part are responsible for the flight performance of the golf ball 2.

In light of the flight performance, the angle $\alpha$1 is more preferably equal to or less than 10.0°, and particularly preferably equal to or less than 9.0°. When the angle $\alpha$1 is too small, the air flowed into the bowl-shaped part from the side face 14 causes separation in the vicinity of the point P. When the separation is caused, sufficient dimple effect is not achieved. In this respect, the angle $\alpha$1 is preferably equal to or greater than 2.0°, more preferably equal to or greater than 3.0°, and particularly preferably equal to or greater than 4.0°.

The curvature radius r of the curved face 16 is preferably 1 mm or greater and 60 mm or less. When the curvature radius r is less than the above range, the dimple 8 is liable to be clogged with sand dust when the golf ball 2 is used on a golf course. In this respect, the curvature radius r is more preferably equal to or greater than 3 mm, and particularly preferably equal to or greater than 4 mm. When the curvature radius r is beyond the above range, air flow in the bowl-shaped part may not be smooth. In this respect, the curvature radius r is more preferably equal to or less than 57 mm, and particularly preferably equal to or less than 54 mm.

In instances of a dimple 8 which includes one truncated cone part and one bowl-shaped part, each volume of the truncated cone part and the bowl-shaped part is preferably 5% or greater and 95% or less of the volume of the dimple 8, in light of the flight performance. Each volume of the truncated cone part and the bowl-shaped part is more preferably equal to or greater than 15%, and particularly preferably equal to or greater than 20% of the dimple 8.

In instances of a dimple 8 which includes one truncated cone part and one bowl-shaped part, each height of the truncated cone part and the bowl-shaped part is preferably equal to or greater than 0.04 mm, and more preferably equal to or greater than 0.06 mm, in light of the flight performance.

Diameter of the dimple 8 is preferably 2.00 mm or greater and 6.0 mm or less. When the diameter is less than the above range, the dimple effect is hardly achieved. In this respect, the diameter is more preferably equal to or greater than 2.20 mm, and particularly preferably equal to or greater than 2.40 mm. When the diameter is greater than the above range, fundamental feature of the golf ball 2 which is substantially a sphere may be compromised. In this respect, the diameter is more preferably equal to or less than 5.8 mm, and particularly preferably equal to or less than 5.6 mm.

Area of a circle formed on the basis of the line segment L1 as a diameter is an area s of the dimple 8. According to the golf ball 2 shown in FIG. 1 to FIG. 4, the area of the dimple A is 16.62 $mm^2$, and the area of the dimple B is 9.62 $mm^2$. Ratio of total area of all the dimples 8 occupied in the surface area of the phantom sphere 12 is referred to as an occupation ratio. From the standpoint that a sufficient dimple effect is achieved, the occupation ratio is preferably equal to or greater than 70%, more preferably equal to or greater than 72%, and particularly preferably equal to or greater than 74%. The occupation ratio is preferably equal to or less than 90%, more preferably equal to or less than 88%, and particularly preferably equal to or less than 86%. According to the golf ball 2 shown in FIG. 1 to FIG. 4, total area of the dimples 8 is 4408.3 $mm^2$. Because the surface area of the phantom sphere 12 of this golf ball 2 is 5728.0 $mm^2$ the occupation ratio is 77.0%.

It is preferred that the depth of the dimple 8 is 0.05 mm or greater and 0.60 mm or less. When the depth is less than the above range, a hopping trajectory may be provided. In this respect, the depth is more preferably equal to or greater than 0.08 mm, and particularly preferably equal to or greater than 0.10 mm. When the depth is beyond than the above range, a dropping trajectory may be provided. In this respect, the depth is more preferably equal to or less than 0.45 mm, and particularly preferably equal to or less than 0.40 mm.

It is preferred that total volume of the dimples 8 is 250 $mm^3$ or greater and 400 $mm^3$ or less. When the total volume is less than the above range, a hopping trajectory may be provided. In this respect, the total volume is more preferably equal to or greater than 260 $mm^3$, and particularly preferably equal to or greater than 270 $mm^3$. When the total volume is beyond the above range, a dropping trajectory may be provided. In this respect, the total volume is more preferably equal to or less than 390 $mm^3$, and particularly preferably equal to or less than 380 $mm^3$.

It is preferred that total number of the dimples 8 is 200 or greater and 500 or less. When the total number is less than the above range, the dimple effect is hardly achieved. In this respect, the total number is more preferably equal to or greater than 240, and particularly preferably equal to or greater than 260. When the total number is beyond the above range, the dimple effect is hardly achieved due to small size of the individual dimples 8. In this respect, the total number is more preferably equal to or less than 480, and particularly preferably equal to or less than 460.

Other dimple may be present mixed with the dimples 8 having the side face 14 and the bowl-shaped part, on the golf ball 2. In this instance, ratio of the number of the dimples 8, which have the side face 14 and the bowl-shaped part, occupied in total number of the dimples is preferably equal to or greater than 50%, more preferably equal to or greater than 70%, and particularly preferably 100%.

Figure 5:
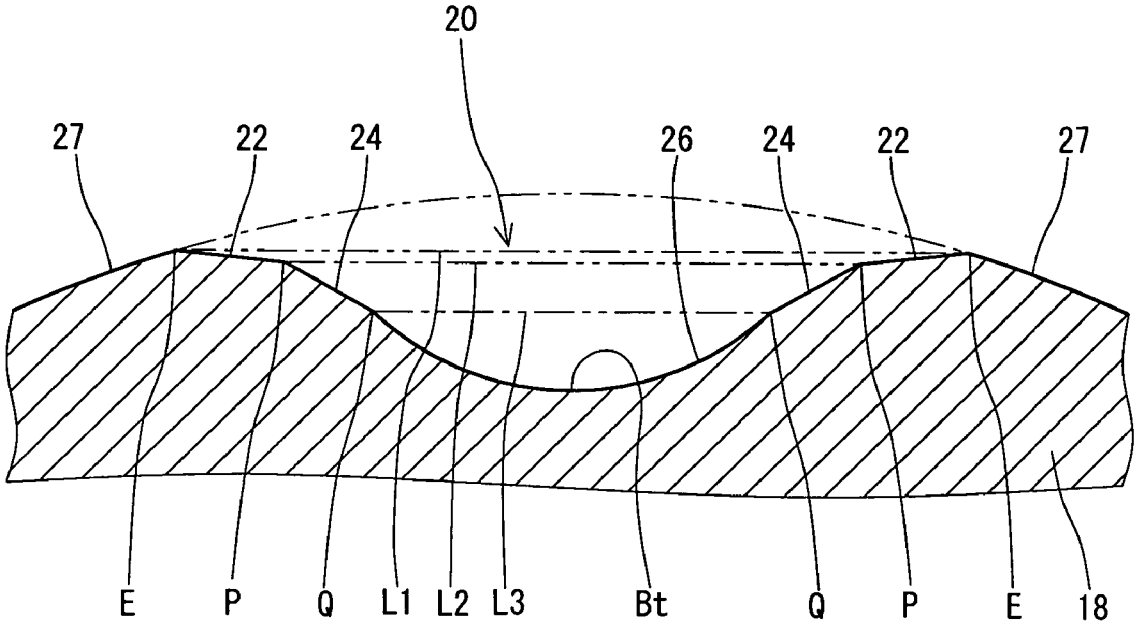
FIG. 5 is a cross-sectional view illustrating a part of a golf ball according to other embodiment of the present invention.

FIG. 5 is a cross-sectional view illustrating a part of a golf ball 18 according to other embodiment of the present invention. This golf ball 18 has dimples 20. In this FIG. 5, a face traversing the deepest point Bt of the dimple 20 and the center of the golf ball 18 is shown. A first side face 22 and a second side face 24 are depicted in FIG. 5. Each of the first side face 22 and the second side face 24 has a ring shape. In FIG. 5, the first side face 22 and the second side face 24 are depicted as a line segment. The first side face 22 is positioned between an edge E and a point P. The first side face 22 is inclined in the in-depth direction from the edge E toward the inward side. The second side face 24 is positioned between the point P and a point Q. The second side face 24 is continued to the first side face 22 at the point P. The second side face 24 is inclined in the in-depth direction from the point P toward the inward side.

A curved face 26 is also depicted in FIG. 5. The curved face 26 is positioned below the point Q. The point Q is a boundary between the second side face 24 and the curved face 26. The curved face 26 is positioned at the center of the dimple 20. The curved face 26 is apart of a spherical surface. In FIG. 5, the curved face 26 is depicted as a circular arc. The curved face 26 is protruded downward. The curved face 26 may have a plurality of curvature radii.

What is indicated by a symbol L1 in FIG. 5 is a line segment connecting the edges E on both sides. What is indicated by a symbol L2 is a line segment connecting the points P on both sides. What is indicated by a symbol L3 is a line segment connecting the points Q on both sides. The first truncated cone part is formed with a horizontal plane including the line segment L1, a horizontal plane including the line segment L2 and the first side face 22. The length of the line segment L1 is a diameter of the bottom face of the first truncated cone part. The length of the line segment L1 is also a diameter of the dimple 20. The second truncated cone part is formed with a horizontal plane including the line segment L2, a horizontal plane including the line segment L3 and the second side face 24. The length of the line segment L2 is a diameter of the bottom face of the second truncated cone part. The bowl-shaped part is formed with the horizontal plane including the line segment L3 and the curved face 26. The length of the line segment L3 is a diameter of the bowl-shaped part.

A distance between the line segment L1 and the line segment L2 is the height of the first truncated cone part. A distance between the line segment L2 and the line segment L3 is the height of the second truncated cone part. A distance between the line segment L3 and the deepest point Bt is the height of the bowl-shaped part. Sum total of the height of the first truncated cone part, the height of the second truncated cone part and the height of the bowl-shaped part is the depth of the dimple 20. Sum total of the volume of the first truncated cone part, the volume of the second truncated cone part and the volume of the bowl-shaped part is the volume of the dimple 20.

Figure 6:
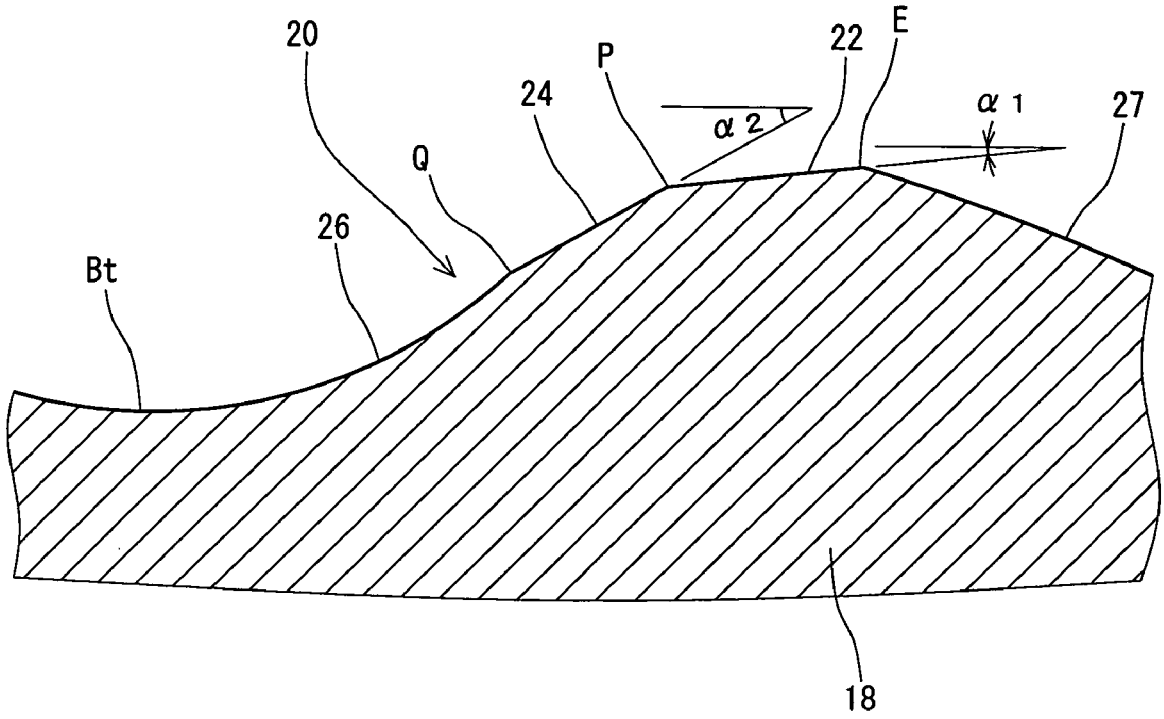
FIG. 6 is a cross-sectional view illustrating the further enlarged golf ball shown in FIG. 5.

FIG. 6 is a cross-sectional view illustrating the further enlarged golf ball 18 shown in FIG. 5. What is indicated by an arrowhead $\alpha$1 in FIG. 6 is an angle of the first side face 22 with respect to the radial direction. The angle $\alpha$1 is equal to or less than 11.0°. The angle $\alpha$1 is extremely small. According to this dimple 20, the air flowing from the land 27 toward the deepest point Bt along the first side face 22 hardly causes separation. In this respect, the angle $\alpha$1 is more preferably equal to or less than 10.0°, and particularly preferably equal to or less than 9.0°. When the angle $\alpha$1 is too small, the air flowed into the bowl-shaped part from the first side face 22 causes separation in the vicinity of the point P. When the separation is caused, sufficient dimple effect is not achieved. In this respect, the angle $\alpha$1 is preferably equal to or greater than 2.0°, more preferably equal to or greater than 3.0°, and particularly preferably equal to or greater than 4.0°.

What is indicated by a symbol $\alpha$2 in FIG. 6 is an angle of the second side face 24 with respect to the radial direction. The air flows from the land 27 into the bowl-shaped part via the first side face 22 and the second side face 24. In light of suppression of the separation of the air, the angle $\alpha$2 is preferably equal to or less than 30.0°, and more preferably equal to or less than 20.0°. It is preferred that the angle $\alpha$2 is greater than the angle $\alpha$1. On behalf of the angle $\alpha$2 which is greater than the angle $\alpha$1, the direction of the air is gradually changed along the first side face 22, the second side face 24 and the curved face 26. The separation is thereby suppressed. In light of suppression of the separation, ($\alpha$2−$\alpha$1) is preferably equal to or greater than 1.0°, and more preferably equal to or greater than 2.0°.

The curvature radius of the curved face 26 is preferably 1 mm or greater and 60 mm or less. When the curvature radius is less than the above range, the dimple 20 is liable to be clogged with sand dust when the golf ball 18 is used on a golf course. In this respect, the curvature radius is more preferably equal to or greater than 3 mm, and particularly preferably equal to or greater than 4 mm. When the curvature radius is beyond the above range, air flow in the bowl-shaped part may not be smooth. In this respect, the curvature radius is more preferably equal to or less than 57 mm, and particularly preferably equal to or less than 54 mm.

In instances of a dimple 20 which includes the first truncated cone part, the second truncated cone part and the bowl-shaped part, each volume of the first truncated cone part, the second truncated cone part and the bowl-shaped part is preferably 3% or greater and 95% or less of the volume of the dimple 20, in light of the flight performance. Each volume of the first truncated cone part, the second truncated cone part and the bowl-shaped part is more preferably equal to or greater than 4%, and particularly preferably equal to or greater than 5% of the dimple 20.

In instances of a dimple 20 which includes the first truncated cone part, the second truncated cone part and the bowl-shaped part, each height of the first truncated cone part, the second truncated cone part and the bowl-shaped part is preferably equal to or greater than 0.03 mm, and more preferably equal to or greater than 0.05 mm, in light of the flight performance.

Figure 7:
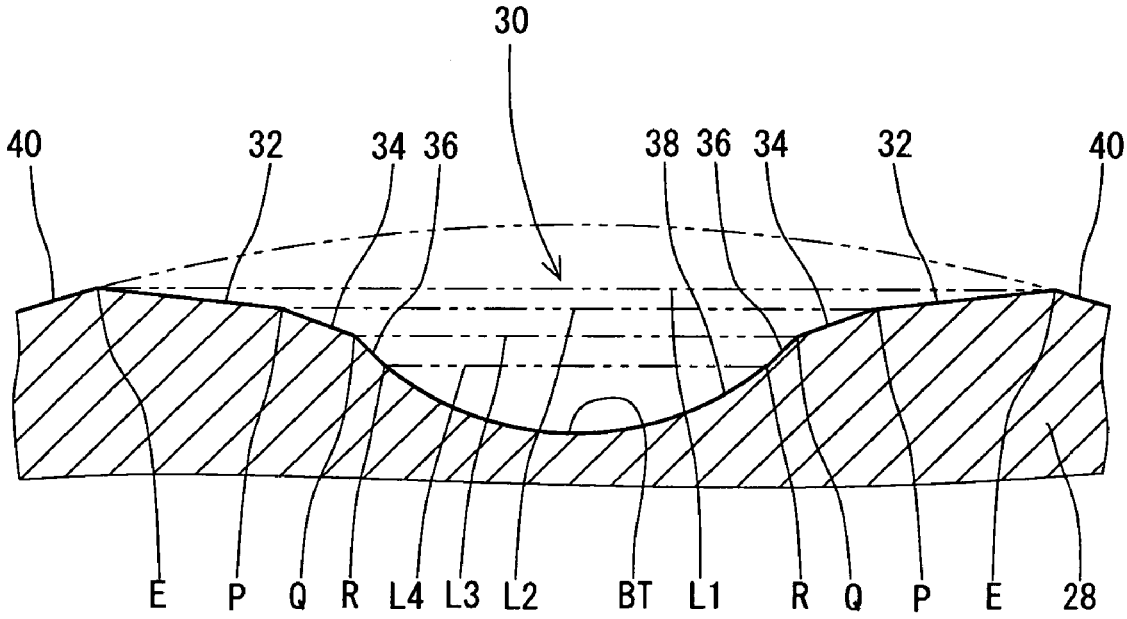
FIG. 7 is a cross-sectional view illustrating a part of a golf ball according to still other embodiment of the present invention.

FIG. 7 is a cross-sectional view illustrating a part of a golf ball 28 according to still other embodiment of the present invention. This golf ball 28 has dimples 30. In this FIG. 7, a face traversing the deepest point Bt of the dimple 30 and the center of the golf ball 28 is shown. A first side face 32, a second side face 34 and a third side face 36 are depicted in FIG. 7. Each of the first side face 32, the second side face 34 and the third side face 36 has a ring shape. In FIG. 7, the first side face 32, the second side face 34 and the third side face 36 are depicted as a line segment. The first side face 32 is positioned between an edge E and a point P. The first side face 32 is inclined in the in-depth direction from the edge E toward the inward side. The second side face 34 is positioned between the point P and a point Q. The second side face 34 is continued to the first side face 32 at the point P. The second side face 34 is inclined in the in-depth direction from the point P toward the inward side. The third side face 36 is positioned between the point Q and a point R. The third side face 36 is continued to the second side face 34 at the point Q. The third side face 36 is inclined in the in-depth direction from the point Q toward the inward side.

A curved face 38 is also depicted in FIG. 7. The curved face 38 is positioned below the point R. The point R is a boundary between the third side face 36 and the curved face 38. The curved face 38 is positioned at the center of the dimple 30. The curved face 38 is a part of a spherical surface. In FIG. 7, the curved face 38 is depicted as a circular arc. The curved face 38 is protruded downward. The curved face 38 may have a plurality of curvature radii.

What is indicated by a symbol L1 in FIG. 7 is a line segment connecting the edges E on both sides. What is indicated by a symbol L2 is a line segment connecting the points P on both sides. What is indicated by a symbol L3 is a line segment connecting the points Q on both sides. What is indicated by a symbol L4 is a line segment connecting the points R on both sides. The first truncated cone part is formed with a horizontal plane including the line segment L1, a horizontal plane including the line segment L2 and the first side face 32. The length of the line segment L1 is a diameter of the bottom face of the first truncated cone part. The length of the line segment L1 is also a diameter of the dimple 30. The second truncated cone part is formed with a horizontal plane including the line segment L2, a horizontal plane including the line segment L3 and the second side face 34. The length of the line segment L2 is a diameter of the bottom face of the second truncated cone part. The third truncated cone part is formed with a horizontal plane including the line segment L3, a horizontal plane including the line segment L4 and the third side face 36. The length of the line segment L3 is a diameter of the bottom face of the third truncated cone part. The bowl-shaped part is formed with the horizontal plane including the line segment L4 and the curved face 38. The length of the line segment L4 is a diameter of the bowl-shaped part.

A distance between the line segment L1 and the line segment L2 is the height of the first truncated cone part. A distance between the line segment L2 and the line segment L3 is the height of the second truncated cone part. A distance between the line segment L3 and the line segment L4 is the height of the third truncated cone part. A distance between the line segment L4 and the deepest point Bt is the height of the bowl-shaped part. Sum total of the height of the first truncated cone part, the height of the second truncated cone part, the height of the third truncated cone part and the height of the bowl-shaped part is the depth of the dimple 30. Sum total of the volume of the first truncated cone part, the volume of the second truncated cone part, the volume of the third truncated cone part and the volume of the bowl-shaped part is the volume of the dimple 30.

Figure 8:
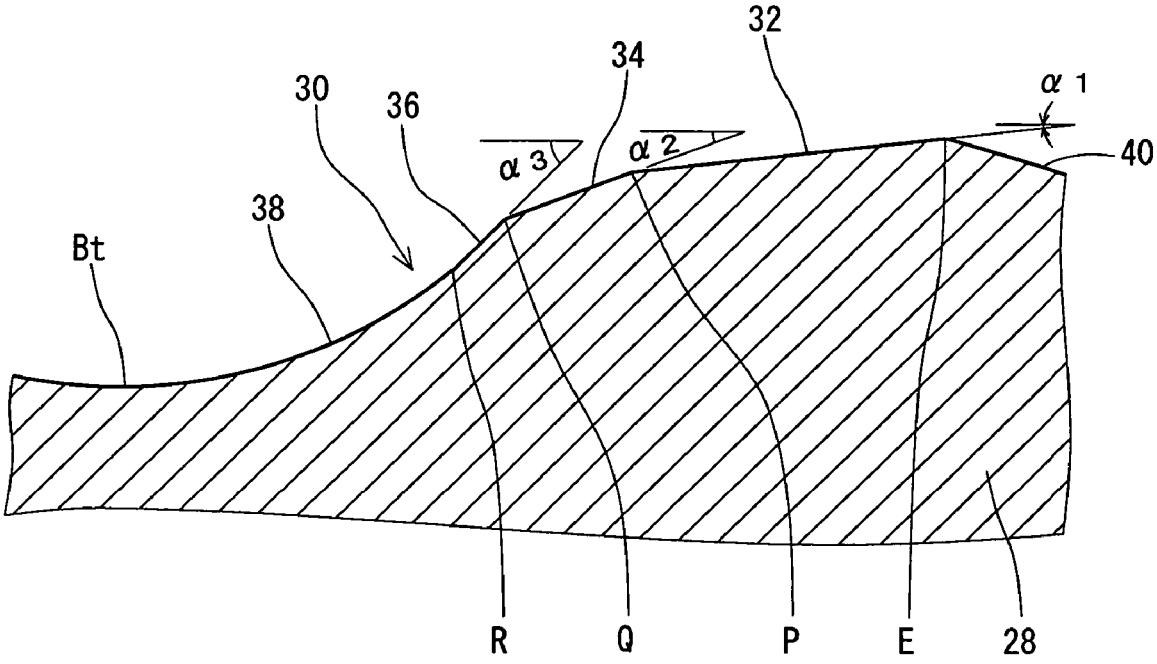
FIG. 8 is a cross-sectional view illustrating the further enlarged golf ball shown in FIG. 7.

FIG. 8 is a cross-sectional view illustrating the further enlarged golf ball 28 shown in FIG. 7. What is indicated by an arrowhead $\alpha 1$ in FIG. 8 is an angle of the first side face 32 with respect to the radial direction. The angle $\alpha 1$ is equal to or less than 11.0°. The angle $\alpha 1$ is extremely small. According to this dimple 30, the air flowing from the land 40 toward the deepest point Bt along the first side face 32 hardly causes separation. In this respect, the angle $\alpha 1$ is more preferably equal to or less than 10.0°, and particularly preferably equal to or less than 9.0°. When the angle $\alpha 1$ is too small, the air flowed into the bowl-shaped part from the first side face 32 causes separation in the vicinity of the point P. When the separation is caused, sufficient dimple effect is not achieved. In this respect, the angle $\alpha 1$ is preferably equal to or greater than 2.0°, more preferably equal to or greater than 3.0°, and particularly preferably equal to or greater than 4.0°.

In FIG. 8, what is indicated by a symbol $\alpha 2$ is an angle of the second side face 34 with respect to the radial direction, and what is indicated by a symbol $\alpha 3$ is an angle of the third side face 36 with respect to the radial direction. The air flows from the land 40 into the bowl-shaped part via the first side face 32, the second side face 34 and the third side face 36. In light of suppression of the separation of the air, the angle $\alpha 2$ and the angle $\alpha 3$ are preferably equal to or less than 30.0°, and more preferably equal to or less than 20.0°. It is preferred that the angle $\alpha 2$ is greater than the angle $\alpha 1$, and the angle $\alpha 3$ is greater than the angle $\alpha 2$. Thus, the direction of the air is gradually changed along the first side face 32, the second side face 34, the third side face 36 and the curved face 38. The separation of the air is thereby suppressed. In light of suppression of the separation, ($\alpha 2-\alpha 1$) and ($\alpha 3-\alpha 2$) is preferably equal to or greater than 1.0°, and more preferably equal to or greater than 2.0°.

The curvature radius of the curved face 38 is preferably 1 mm or greater and 60 mm or less. When the curvature radius is less than the above range, the dimple 30 is liable to be clogged with sand dust when the golf ball 28 is used on a golf course. In this respect, the curvature radius is more preferably equal to or greater than 3 mm, and particularly preferably equal to or greater than 4 mm. When the curvature radius is beyond the above range, air flow in the bowl-shaped part may not be smooth. In this respect, the curvature radius is more preferably equal to or less than 57 mm, and particularly preferably equal to or less than 54 mm.

In instances of a dimple 30 which includes the first truncated cone part, the second truncated cone part, the third truncated cone part and the bowl-shaped part, each volume of the first truncated cone part, the second truncated, the third truncated cone part cone part and the bowl-shaped part is preferably 2% or greater and 95% or less of the volume of the dimple 30, in light of the flight performance. Each volume of the first truncated cone part, the second truncated cone part, the third truncated cone part and the bowl-shaped part is more preferably equal to or greater than 3%, and particularly preferably equal to or greater than 4% of the dimple 30.

In instances of a dimple 30 which includes the first truncated cone part, the second truncated cone part, the third truncated cone part and the bowl-shaped part, each height of the first truncated cone part, the second truncated cone part, the third truncated cone part and the bowl-shaped part is preferably equal to or greater than 0.02 mm, and more preferably equal to or greater than 0.04 mm, in light of the flight performance.

The dimple may have four or more truncated cone parts and one bowl-shaped part. Also in this instance, it is preferred that the truncated cone part has the side face with smaller angle of inclination as it is closer to the edge. The angle of inclination of the side face which is the closest to the edge is preferably 2.0° or greater and 11.0° or less. The height of each truncated cone part is preferably equal to or greater than 0.02 mm.

EXAMPLES

Example 1

A rubber composition was obtained by kneading 100 parts by weight of polybutadiene (trade name "BR-11", available from JSR Corporation), 24 parts by weight of zinc diacrylate, 10 parts of zinc oxide, 25 parts by weight of barium sulfate and 0.8 part by weight of dicumyl peroxide. This rubber composition was placed into a mold having upper and lower mold half each having a hemispherical cavity, and heated at a temperature of 160° C. for 20 minutes to obtain a core having a diameter of 38.3 mm. On the other hand, a resin composition was obtained by kneading 50 parts by weight of an ionomer resin (trade name "Himilan 1605", available from Du Pont-MITSUI POLYCHEMICALS Co., Ltd.), 50 parts by weight of another ionomer resin (trade name "Himilan 1706", available from Du Pont-MITSUI POLYCHEMICALS Co., Ltd.) and 3 parts of titanium dioxide. The aforementioned core was placed into a mold having numerous protrusions on the inside face, followed by injection of the aforementioned resin composition around the core according to an injection molding method to form a cover having a thickness of 2.2 mm. Numerous dimples having a shape inverted from the shape of the protrusion were formed on the cover. Paint was applied on this cover to give a golf ball of Example 1 having a diameter of about 42.7 mm and compression of about 85. Specifications of the dimples of this golf ball are presented in Table 1 below. Each dimple has a cross-sectional shape illustrated in FIG. 7 and FIG. 8. Each dimple has a first truncated cone part, a second truncated cone part, a third truncated cone part and a bowl-shaped part.

Examples 2 to 5 and Comparative Examples 1 to 3

In a similar manner to Example 1 except that the mold was changed to alter specifications of the dimples as presented in Table 1 and Tale 2 below, golf balls of Examples 2 to 5 and Comparative Examples 1 to 3 were obtained.

TABLE 1

Specification of dimples

| | | | Example 1 | Example 2 | Example 3 | Example 4 |
|---|---|---|---|---|---|---|
| Dimple A | First truncated cone part | Diameter of bottom face (mm) | 4.60 | 4.60 | 4.60 | 4.60 |
| | | Angle α1 (deg.) | 5.0 | 10.0 | 3.0 | 3.0 |
| | | Height (mm) | 0.045 | 0.030 | 0.030 | 0.020 |
| | | Volume ($mm^3$) | 0.593 | 0.463 | 0.385 | 0.280 |
| | Second truncated cone part | Diameter of bottom face (mm) | 3.57 | 4.26 | 3.46 | 3.84 |
| | | Angle α2 (deg.) | 7.0 | 8.0 | 9.0 | 8.0 |
| | | Height (mm) | 0.050 | 0.030 | 0.060 | 0.050 |
| | | Volume ($mm^3$) | 0.395 | 0.386 | 0.448 | 0.478 |
| | Third truncated cone part | Diameter of bottom face (mm) | 2.76 | 3.83 | 2.70 | 3.13 |
| | | Angle α3 (deg.) | 9.0 | 6.0 | 33.0 | 9.0 |
| | | Height (mm) | 0.065 | 0.030 | 0.065 | 0.060 |
| | | Volume ($mm^3$) | 0.284 | 0.297 | 0.345 | 0.358 |
| | Bowl-shaped part | Diameter (mm) | 1.94 | 3.26 | 2.50 | 2.37 |
| | | Curvature radius (mm) | 13.0 | 51.2 | 11.2 | 7.1 |
| | | Height (mm) | 0.036 | 0.026 | 0.070 | 0.100 |
| | | Volume ($mm^3$) | 0.053 | 0.109 | 0.172 | 0.221 |
| Dimple B | First truncated cone part | Diameter of bottom face (mm) | 3.50 | 3.50 | 3.50 | 3.50 |
| | | Angle α1 (deg.) | 5.0 | 10.0 | 3.0 | 3.0 |
| | | Height (mm) | 0.045 | 0.030 | 0.030 | 0.200 |
| | | Volume ($mm^3$) | 0.318 | 0.261 | 0.205 | 0.154 |
| | Second truncated cone part | Diameter of bottom face (mm) | 2.47 | 3.16 | 2.36 | 2.74 |
| | | Angle α2 (deg.) | 7.0 | 8.0 | 9.0 | 8.0 |
| | | Height (mm) | 0.050 | 0.030 | 0.060 | 0.050 |
| | | Volume ($mm^3$) | 0.169 | 0.205 | 0.186 | 0.224 |

TABLE 1-continued

| Specification of dimples | | | Example 1 | Example 2 | Example 3 | Example 4 |
|---|---|---|---|---|---|---|
| | Third truncated cone part | Diameter of bottom face (mm) | 1.66 | 2.73 | 1.60 | 2.03 |
| | | Angle α3 (deg.) | 9.0 | 6.0 | 33.0 | 9.0 |
| | | Height (mm) | 0.065 | 0.030 | 0.065 | 0.060 |
| | | Volume ($mm^3$) | 0.082 | 0.142 | 0.115 | 0.130 |
| | Bowl-shaped part | Diameter (mm) | 0.84 | 2.16 | 1.40 | 1.27 |
| | | Curvature radius (mm) | 2.4 | 22.5 | 3.5 | 2.1 |
| | | Height (mm) | 0.036 | 0.026 | 0.070 | 0.100 |
| | | Volume ($mm^3$) | 0.010 | 0.048 | 0.054 | 0.064 |

TABLE 2

| Specification of dimples | | | Example 5 | Comp. Example 1 | Comp. Example 2 | Comp. Example 3 |
|---|---|---|---|---|---|---|
| Dimple A | First truncated cone part | Diameter of bottom face (mm) | 4.60 | 4.60 | 4.60 | Absent |
| | | Angle α1 (deg.) | 9.0 | 1.8 | 13.0 | |
| | | Height (mm) | 0.020 | 0.020 | 0.025 | |
| | | Volume ($mm^3$) | 0.314 | 0.715 | 0.396 | |
| | Second truncated cone part | Diameter of bottom face (mm) | 4.35 | 3.29 | 4.38 | Absent |
| | | Angle α2 (deg.) | 10.0 | 20.0 | 15.0 | |
| | | Height (mm) | 0.030 | 0.053 | 0.030 | |
| | | Volume ($mm^3$) | 0.411 | 0.412 | 0.430 | |
| | Third truncated cone part | Diameter of bottom face (mm) | 4.01 | 3.00 | 4.16 | Absent |
| | | Angle α3 (deg.) | 11.0 | 23.3 | 17.0 | |
| | | Height (mm) | 0.030 | 0.060 | 0.020 | |
| | | Volume ($mm^3$) | 0.350 | 0.386 | 0.263 | |
| | Bowl-shaped part | Diameter (mm) | 3.70 | 2.72 | 4.03 | 4.60 |
| | | Curvature radius (mm) | 55.2 | 8.9 | 92.0 | 18.3 |
| | | Height (mm) | 0.031 | 0.105 | 0.022 | 0.145 |
| | | Volume ($mm^3$) | 0.167 | 0.306 | 0.140 | 1.206 |
| Dimple B | First truncated cone part | Diameter of bottom face (mm) | 3.50 | 3.50 | 3.50 | Absent |
| | | Angle α1 (deg.) | 9.0 | 1.8 | 13.0 | |
| | | Height (mm) | 0.020 | 0.020 | 0.025 | |
| | | Volume ($mm^3$) | 0.179 | 0.129 | 0.226 | |
| | Second truncated cone part | Diameter of bottom face (mm) | 3.25 | 2.19 | 3.28 | Absent |
| | | Angle α2 (deg.) | 10.0 | 20.0 | 15.0 | |
| | | Height (mm) | 0.030 | 0.053 | 0.030 | |
| | | Volume ($mm^3$) | 0.223 | 0.174 | 0.237 | |
| | Third truncated cone part | Diameter of bottom face (mm) | 2.91 | 1.90 | 3.06 | Absent |
| | | Angle α3 (deg.) | 11.0 | 23.3 | 17.0 | |
| | | Height (mm) | 0.030 | 0.060 | 0.020 | |
| | | Volume ($mm^3$) | 0.179 | 0.146 | 0.141 | |
| | Bowl-shaped part | Diameter (mm) | 2.60 | 1.62 | 2.93 | 3.50 |
| | | Curvature radius (mm) | 27.2 | 3.2 | 48.7 | 10.6 |
| | | Height (mm) | 0.031 | 0.105 | 0.022 | 0.145 |
| | | Volume ($mm^3$) | 0.082 | 0.109 | 0.074 | 0.699 |

[Travel Distance Test]

A driver (trade name "XXIO", available from Sumitomo Rubber Industries, Ltd., shaft hardness: X) was equipped with a swing machine, available from True Temper Co. Then the golf ball was hit under the condition of the head speed being about 49 m/sec, the back spin rate being about 3000 rpm and the launch angle being about 11°. Accordingly, the distance from the launching point to the point where the ball stopped was measured. It was windless during the measurement. Mean values of 20 times measurement are shown in Table 3 below.

TABLE 3

| Results of evaluation | | Example 1 | Example 2 | Example 3 | Example 4 | Example 5 | Comp. Example 1 | Comp. Example 2 | Comp. Example 3 |
|---|---|---|---|---|---|---|---|---|---|
| Dimple A | Number | 168 | 168 | 168 | 168 | 168 | 168 | 168 | 168 |
| | Diameter (mm) | 4.60 | 4.60 | 4.60 | 4.60 | 4.60 | 4.60 | 4.60 | 4.60 |
| | Depth (mm) | 0.196 | 0.116 | 0.225 | 0.230 | 0.110 | 0.238 | 0.097 | 0.145 |
| | Volume ($mm^3$) | 1.325 | 1.255 | 1.349 | 1.336 | 1.242 | 1.350 | 1.230 | 1.206 |
| | Truncated cone part | Present | Present | Present | Present | Present | Present | Present | Absent |

TABLE 3-continued

| | | Results of evaluation | | | | | | | |
|---|---|---|---|---|---|---|---|---|---|
| | | Example 1 | Example 2 | Example 3 | Example 4 | Example 5 | Comp. Example 1 | Comp. Example 2 | Comp. Example 3 |
| | α1 (degree) | 5.0 | 10.0 | 3.0 | 3.0 | 9.0 | 1.8 | 13.0 | — |
| | α2 (degree) | 7.0 | 8.0 | 9.0 | 8.0 | 10.0 | 20.0 | 15.0 | — |
| | α3 (degree) | 9.0 | 6.0 | 33.0 | 9.0 | 11.0 | 23.3 | 17.0 | — |
| Dimple B | Number | 168 | 168 | 168 | 168 | 168 | 168 | 168 | 168 |
| | Diameter (mm) | 3.50 | 3.50 | 3.50 | 3.50 | 3.50 | 3.50 | 3.50 | 3.50 |
| | Depth (mm) | 0.196 | 0.116 | 0.225 | 0.230 | 0.110 | 0.238 | 0.970 | 0.145 |
| | Volume ($mm^3$) | 0.580 | 0.656 | 0.559 | 0.571 | 0.663 | 0.559 | 0.678 | 0.699 |
| | Truncated cone part | Present | Present | Present | Present | Present | Present | Present | Absent |
| | α1 (degree) | 5.0 | 10.0 | 3.0 | 3.0 | 9.0 | 1.8 | 13.0 | — |
| | α2 (degree) | 7.0 | 8.0 | 9.0 | 8.0 | 10.0 | 20.0 | 15.0 | — |
| | α3 (degree) | 9.0 | 6.0 | 33.0 | 9.0 | 11.0 | 23.3 | 17.0 | — |
| Total number of dimples | | 336 | 336 | 336 | 336 | 336 | 336 | 336 | 336 |
| Total volume ($mm^3$) | | 320.1 | 320.9 | 320.6 | 320.5 | 320.1 | 320.7 | 320.5 | 320.1 |
| Travel distance (m) | | 238.1 | 235.5 | 236.8 | 233.2 | 232.0 | 229.5 | 228.7 | 227.6 |

In Table 3, greater travel distance is achieved by the golf balls of Examples in comparison with the golf balls of Comparative Examples. Therefore, advantages of the present invention are clearly indicated by these results of evaluation.

The dimple according to the present invention may be applied not only to two-piece golf balls, but also to one-piece golf balls, multi-piece golf balls and wound golf balls.

The description herein above is just for an illustrative example, therefore, various modifications can be made without departing from the principles of the present invention.

What is claimed is:

1. A golf ball having numerous dimples on the surface thereof, said dimple comprising a truncated cone part having a side face inclined in the in-depth direction from the edge toward the inward side, an angle α1 of said side face with respect to the radial direction being 2.0° or greater and 10.0° or less, and wherein said dimple has a bowl-shaped part which is positioned at the center thereof.

2. The golf ball according to claim 1, wherein the angle α1 is 3.0° or greater and 10.0° or less.

3. The golf ball according to claim 1, wherein the angle α1 is 4.0° or greater and 9.0° or less.

4. A golf ball having numerous dimples on the surface thereof, said dimple comprising:

(1) a first truncated cone part having a side face inclined in the in-depth direction from the edge toward the inward side;

(2 ) a second truncated cone part having a side face inclined in the in-depth direction toward the inward side, and continuing to the first truncated cone part; and (3) a bowl-shaped part which is positioned at the center thereof, an angle α1 of said side face of the first truncated cone part with respect to the radial direction being 2.0° or greater and 11.0° or less, and wherein an angle α2 of said side face of the second truncated cone part with respect to the radial direction is greater than the angle α1, and the angle α2 is equal to or less than 30.0°.

5. The golf ball according to claim 4, wherein the angle α2 is equal to or less than 20.0°.

6. The golf ball according to claim 4, wherein the angle α2 is 1.0° or greater than the angle α1.

7. The golf ball according to claim 4, wherein the angle α2 is 2.0° or greater than the angle α1.

8. A golf ball having numerous dimples on the surface thereof, said dimple comprising:

(1) a first truncated cone part having a side face inclined in the in-depth direction from the edge toward the inward side;

(2) a second truncated cone part having a side face inclined in the in-depth direction toward the inward side, and continuing to the first truncated cone part;

(3) a third truncated cone part having a side face inclined in the in-depth direction toward the inward side, and continuing to the second truncated cone part; and (4) a bowl-shaped part which is positioned at the center thereof, an angle α1 of said side face of the first truncated cone part with respect to the radial direction being 2.0° or greater and 11.0° or less, and wherein an angle α2 of said side face of the second truncated cone part with respect to the radial direction is greater than the angle α1, and the angle α2 is equal to or less than 30.0°, an angle α3 of said side face of the third truncated cone part with respect to the radial direction is greater than the angle α2, and the angle α3 is equal to or less than 30.0°.

9. The golf ball according to claim 8, wherein the angle α3 is equal to or less than 20.0°.

* * * * *